US005768132A

United States Patent [19]

Cordery et al.

[11] Patent Number: 5,768,132

[45] Date of Patent: Jun. 16, 1998

[54] CONTROLLED ACCEPTANCE MAIL SYSTEM SECURELY ENABLING REUSE OF DIGITAL TOKEN INITIALLY GENERATED FOR A MAILPIECE ON A SUBSEQUENTLY PREPARED DIFFERENT MAILPIECE TO AUTHENTICATE PAYMENT OF POSTAGE

[75] Inventors: Robert A. Cordery, Danbury; Leon A. Pintsov, W. Hartford; Monroe A. Weiant, Jr., Trumbull, all of Conn.

[73] Assignee: Pitney Bowes Inc., Stamford, Conn.

[21] Appl. No.: 665,268

[22] Filed: Jun. 17, 1996

[51] Int. Cl.[6] ..... G07B 17/00

[52] U.S. Cl. ..... 364/464.2

[58] Field of Search ..... 364/464.14, 464.18, 364/464.2; 395/230, 234

[56] References Cited

U.S. PATENT DOCUMENTS

| | | | |
|---|---|---|---|
| 4,571,601 | 2/1986 | Teshima | 346/140 R |
| 4,757,537 | 7/1988 | Edelmann et al. | 380/51 |
| 4,760,532 | 7/1988 | Sansone et al. | 364/466 X |
| 4,760,534 | 7/1988 | Fougere et al. | 364/466 |
| 4,775,246 | 10/1988 | Edelmann et al. | 380/23 |
| 4,831,555 | 5/1989 | Sansone et al. | 364/464.02 X |
| 4,854,865 | 8/1989 | Sansone et al. | 364/464.02 |
| 4,998,204 | 3/1991 | Sansone et al. | 364/464.02 |
| 5,390,251 | 2/1995 | Pastor et al. | 380/21 |
| 5,437,441 | 8/1995 | Tuhro et al. | 270/1.1 |
| 5,448,641 | 9/1995 | Pintsov et al. | 380/51 |
| 5,454,038 | 9/1995 | Cordery et al. | 380/23 |
| 5,504,897 | 4/1996 | Gans et al. | 395/615 |

*Primary Examiner*—Edward R. Cosimano
*Attorney, Agent, or Firm*—Charles R. Malandra, Jr.; Melvin J. Scolnick

[57] ABSTRACT

A method for mail payment evidencing includes processing a collation of mail where the collation is one of a series of mail collations being created. Payment rating parameters are determined for carrier services to be associated with the mail collation in process. It is determined if a previously generated digital token associated with a previous mail collation which was not completed is suitable for use on said mail collation in process. The previously generated digital token is utilized for the mail collation in process if the previously generated digital token is suitable for use on said mail collation in process. The created mail collations may be submitted to a carrier service with a digitally signed statement of mailing.

20 Claims, 9 Drawing Sheets

5002

| 5004 | 5014 | 5006 | 5016 | 5008 | 5018 | 5012 | 5020 | 5010 |
|---|---|---|---|---|---|---|---|---|
| SOM 00001 | | MAILER ID 1234 | | 1234567 | | PIECE COUNT 0001 TO 0002 01410 | | MAILER ACCOUNT 775532 |
| DATE 2 MAY, 96 | | RATING TABLE 987654 | | SIGNATURE 01234567 | | ERROR CONTROL 001234321 | | 123 MAIN STREET ANYTOWN US 06484 [ACCEPTING PO] 5017 |
| WEIGHT (OZ.) | | SIZE | | DISCOUNT | | POSTAGE | | NUMBER OF PIECES |
| 0.5 | | STANDARD | | FULL | | $0.32 | | 731 5022 |
| 1.0 | | SURCHARGE | | NON-PRESORT | | $0.55 | | 27 |
| 1.7 | | STANDARD | | PRE-BARCODED | | $0.58 | | 567 |
| 1.8 | | SURCHARGE | | PRESORT | | $0.75 | | 85 |
| 94.34 LB | | TOTALS | | | | $635.71 | | 1410 |
| 5024 | | | | | | 5026 | | 5028 |

FIG. 6

| 6012 COLLATION # | 6014 RATING INFORMATION (PARAMETERS) | 6016 INDICIA VARIABLE INFORMATION |
|---|---|---|
| 1 | WEIGHT:15 GR<br>SIZE:STANDARD<br>SERVICE: FIRST CLASS | PIECE COUNT 0000001<br>SCAN ERR. CORR CODE 289<br>POSTAL TOKEN: 1<br>VENDOR TOKEN 2<br>POSTAGE 0.32 |
| 2 | WEIGHT: 1.7 OZ<br>SIZE:STANDARD<br>SERVICE: FIRST CLASS | PIECE COUNT 0000002<br>SCAN ERR. CORR CODE 367<br>POSTAL TOKEN: 5<br>VENDOR TOKEN 3<br>POSTAGE 0.58 |
| 3 | WEIGHT:19 GR<br>SIZE:STANDARD<br>SERVICE: FIRST CLASS | PIECE COUNT 0000003<br>SCAN ERR. CORR CODE 664<br>POSTAL TOKEN: 2<br>VENDOR TOKEN 5<br>POSTAGE 0.32 |
| 4 | WEIGHT:19 GR<br>SIZE:STANDARD<br>SERVICE: FIRST CLASS | PIECE COUNT 0000004<br>SCAN ERR. CORR CODE 982<br>POSTAL TOKEN: 6<br>VENDOR TOKEN 4<br>POSTAGE 0.32 |
| --- | --- | --- |
| 7 | WEIGHT:39 GR<br>SIZE:STANDARD<br>SERVICE: FIRST CLASS | REQUEST IS IN QUEUE |
| 8 | WEIGHT:19 GR<br>SIZE:STANDARD<br>SERVICE: FIRST CLASS | REQUEST IS IN QUEUE |
| 9 | WEIGHT:15 GR<br>SIZE:STANDARD<br>SERVICE: CERTIFIED | REQUEST IS IN QUEUE |

6008

6010

6006

6002

FIG. 7

7004

| SEQUENTIAL # FOR AVAILABLE INDICIAS | RATING INFORMATION | INDICIA VARIABLE INFORMATION |
|---|---|---|
| 1 | WEIGHT: 1.7 OZ<br>SIZE:STANDARD<br>SERVICE: FIRST CLASS | PIECE COUNT 0000002<br>SCAN ERR. CORR CODE 367<br>POSTAL TOKEN: 5<br>VENDOR TOKEN 3<br>POSTAGE 0.58 |
| 2 | WEIGHT: 19 GR<br>SIZE:STANDARD<br>SERVICE: CERTIFIED | PIECE COUNT 0000003<br>SCAN ERR. CORR CODE 664<br>POSTAL TOKEN: 2<br>VENDOR TOKEN 5<br>POSTAGE 0.32 |

6008

6010

FIG. 8

| SEQUENTIAL # FOR COMPLETED INDICIAS | RATING INFORMATION | INDICIA VARIABLE INFORMATION |
|---|---|---|
| 1 | WEIGHT: 15 GR<br>SIZE:STANDARD<br>SERVICE: FIRST CLASS | PIECE COUNT 0000001<br>ERR. CORR CODE 289<br>POSTAL TOKEN: 1<br>VENDOR TOKEN 2<br>POSTAGE 0.32 |
| 2 | WEIGHT: 19 GR<br>SIZE:STANDARD<br>SERVICE: FIRST CLASS | PIECE COUNT 0000004<br>ERR. CORR CODE 982<br>POSTAL TOKEN: 6<br>VENDOR TOKEN 4<br>POSTAGE 0.32 |

8002

FIG. 9

| COLLATION # | RATING INFORMATION | INDICIA VARIABLE INFORMATION |
|---|---|---|
| 1 | WEIGHT:15 GR<br>SIZE:STANDARD<br>SERVICE: FIRST CLASS | PIECE COUNT 0000001<br>SCAN ERR. CORR CODE 289<br>POSTAL TOKEN: 1<br>VENDOR TOKEN 2<br>POSTAGE 0.32 |
| 4 | WEIGHT:19 GR<br>SIZE:STANDARD<br>SERVICE: FIRST CLASS | PIECE COUNT 000000<br>SCAN ERR. CORR CODE 982<br>POSTAL TOKEN: 6<br>VENDOR TOKEN 4<br>POSTAGE 0.32 |
| --- | --- | --- |
| 7 | WEIGHT:39 GR<br>SIZE:STANDARD<br>SERVICE: FIRST CLASS | PIECE COUNT 0000002<br>SCAN ERR. CORR CODE 367<br>POSTAL TOKEN: 5<br>VENDOR TOKEN: 3<br>POSTAGE 0.58 |
| 8 | WEIGHT:19 GR<br>SIZE:STANDARD<br>SERVICE: FIRST CLASS | REQUEST IS IN QUEUE |
| 9 | WEIGHT:25 GR<br>SIZE:STANDARD<br>SERVICE: CERTIFIED | REQUEST IS IN QUEUE |

FIG. 10

| SEQUENTIAL # FOR AVAILABLE INDICIAS | RATING INFORMATION | INDICIA VARIABLE INFORMATION |
|---|---|---|
| 1 | WEIGHT:19 GR<br>SIZE:STANDARD<br>SERVICE: CERTIFIED | PIECE COUNT 0000003<br>SCAN ERR. CORR CODE 664<br>POSTAL TOKEN: 2<br>VENDOR TOKEN 5<br>POSTAGE 0.32 |

6010

FIG. 11

| COLLATION # | RATING INFORMATION | INDICIA VARIABLE INFORMATION |
|---|---|---|
| 8 | WEIGHT:19 GR<br>SIZE:STANDARD<br>SERVICE: FIRST CLASS | PIECE COUNT 0000008<br>SCAN ERR. CORR CODE 456<br>POSTAL TOKEN: 8<br>VENDOR TOKEN: 3<br>POSTAGE 0.32 |
| 9 | WEIGHT:25 GR<br>SIZE:STANDARD<br>SERVICE: CERTIFIED | REQUEST IS IN QUEUE |
| --- | --- | --- |
| --- | --- | --- |
| --- | --- | --- |
| 16 | --- | --- |

1104

1106

FIG. 12

| SEQUENTIAL # FOR COMPLETED INDICIAS | RATING INFORMATION | INDICIA VARIABLE INFORMATION |
|---|---|---|
| 1 | WEIGHT:25 GR<br>SIZE:STANDARD<br>SERVICE: FIRST CLASS | PIECE COUNT 0000001<br>SCAN ERR. CORR CODE 289<br>POSTAL TOKEN: 1<br>VENDOR TOKEN 2<br>POSTAGE 0.32 |
| 2 | WEIGHT:19 GR<br>SIZE:STANDARD<br>SERVICE: FIRST CLASS | PIECE COUNT 0000004<br>SCAN ERR. CORR CODE 982<br>POSTAL TOKEN: 6<br>VENDOR TOKEN 4<br>POSTAGE 0.32 |
| --- | --- | --- |
| 5 | WEIGHT:39 GR<br>SIZE:STANDARD<br>SERVICE: FIRST CLASS | PIECE COUNT 0000002<br>SCAN ERR. CORR CODE 367<br>POSTAL TOKEN: 5<br>VENDOR TOKEN 3<br>POSTAGE 0.58 |

1204

1206

1208

CONTROLLED ACCEPTANCE MAIL SYSTEM SECURELY ENABLING REUSE OF DIGITAL TOKEN INITIALLY GENERATED FOR A MAILPIECE ON A SUBSEQUENTLY PREPARED DIFFERENT MAILPIECE TO AUTHENTICATE PAYMENT OF POSTAGE

FIELD OF THE INVENTION

The present invention pertains to mail payment and evidencing systems and, more particularly, to an error recovery system for a controlled acceptance mail payment and evidencing systems.

BACKGROUND OF THE INVENTION

Various batch mailing systems employing controlled mail acceptance have been developed. For example, a system is disclosed in U.S. patent application Ser. No. 432,733 for CONTROLLED ACCEPTANCE MAIL PAYMENT AND EVIDENCE SYSTEM filed May 2, 1995 (E-381) and in U.S. patent application Ser. No. 629,719 for CLOSED LOOP TRANSACTION BASED MAIL ACCOUNTING AND PAYMENT SYSTEM WITH CARRIER PAYMENT THROUGH A THIRD PARTY INITIATED BY MAILING INFORMATION RELEASE, filed Apr. 9, 1996 (E496). Both of these patent applications are assigned to Pitney Bowes Inc. These systems provide significant advantages in controlled acceptance batch mailing systems.

Error recovery, such as funds recovery, in traditional metering for controlled acceptance mail (i.e. mail that is produced, finished, postaged and/or sorted by an inserter machine, mailing machine or mail sorter) is a difficult, error prone and time consuming process. Often spoiled or otherwise damaged mail that has become non-mailable has been imprinted with postage evidence. Non-mailability may be due to physical mutilation, incorrect contents, printing after mutilation, postage not printed correctly or a decision by a mailer not to utilize a mailpiece. In this case the postage has been paid for by subtracting the postage amount from the value of funds that were loaded in the meter. In order to recover lost postage, the mailer normally has to present spoiled mail together with a special report to the postal authority. Then the postage may be refunded, but, for some postal authorities, only at 90% or lesser of true value. In other words, the mailer frequently losses at least 10% of the postage value in addition to labor and other expenses required for postage to be refunded by postal authorities.

It has been suggested in the above-noted in U.S. patent application Ser. No. 432,733 for CONTROLLED ACCEPTANCE MAIL PAYMENT AND EVIDENCE SYSTEM filed May 2, 1995 (E-381) that mailers from time to time desire refunds for spoiled mailpieces and a refund process and accounting procedure is desirably included in postage payment and evidencing systems and additionally, that the spoiled mailpieces such as mailpieces destroyed by the insertion equipment can be simply recreated and the postage evidence or digital token data stored in the inserter controller memory can be reprinted. In such case the mail piece is recreated and the digital token reused. Fraudulent "salting" of the mail run is detected by the process of weighing the mailpieces batch upon acceptance and, when desired, statistical sampling the postage evidence.

Another method for recovery of funds for spoiled mailpieces suggested in the above-noted in U.S. patent application Ser. No. 432,733 for CONTROLLED ACCEPTANCE MAIL PAYMENT AND EVIDENCE SYSTEM filed May 2, 1995 (E-381) involves a system where the digital token may not be reprinted without being accounted for by the vault system. In systems of this type the indicia printer, which prints the digital token and other information, are securely coupled either by physical security or by encryption security to the accounting vault and a mail error recovery file may be used in a system when indicias (which include the digital tokens) have been reprinted.

SUMMARY OF THE INVENTION

It is an object of the present invention to provide an improved postage payment and evidencing system.

It is a further object of the present invention to provide an effective controlled acceptance process for mail that includes improved flexibility for the mailer in creating mail and a high level of security for payment and evidencing of appropriate postage.

It is yet a further objective of the present invention to employ a digital token system for controlled acceptance mail that allows flexible preparation of mixed weight mail and security of carrier service payment funds.

It has been discovered that controlled mail acceptance systems can be enhanced by providing a capability for reusing digital tokens which was initially generated to provide evidence of postage or carrier service payment on a mailpieces which were not mailed (not completed) on different mailpieces which are not recreations of the not completed mailpieces.

A method for mail payment evidencing in accordance with the present invention includes processing a collation of mail where the collation is one of a series of mail collations being created. A mail collation which is determined to be not suitable for mailing is not completed. It is determined if a previously generated digital token associated with a previous mail collation which was not completed is suitable for use on said mail collation in process. The previously generated digital token is utilized for the mail collation in process if the previously generated digital token is suitable for use on said mail collation in process.

In accordance with a feature of the present invention the created mail collations may be submitted to a carrier service with a digitally signed statement of mailing. In accordance with another feature of the present invention, the statement of mailing may include information concerning generated digital tokens which are not utilized in the series of mail completed collations.

BRIEF DESCRIPTION OF THE DRAWINGS

Reference is now made to the following figures wherein like reference numerals designate similar elements in the various figures and in which:

FIG. 6 is a depiction of a list of collations in process reflecting information which would be maintained within the inserter controller or the controller of any other mail preparation equipment;

FIG. 7 is a list of indicia available for re-use showing the information which would be stored in the inserter controller or controller of any other mail preparation equipment;

FIG. 8 is a list of completed indicias depicting information also stored in the memory of the inserter controller or any other mail preparation equipment;

FIG. 9 is a list of collations in process after reuse of an indicia number 2 depicting the information stored in the inserter controller or controller of other mail preparation equipment;

FIG. 10 is a list of indicias available for reuse after reuse of indicia number 2 depicting information stored in the inserter controller or controller of any other mail preparation equipment;

FIG. 11 is a list of collations in process after completion of collation number 7 depicting information stored in the inserter controller or controller of other equipment used in mail preparation;

FIG. 12 is a list of completed indicias after completion of a collation number 7 depicting information stored in the inserter controller or controller of any other equipment used in mail preparation;

DETAILED DESCRIPTION OF THE PREFERRED EMBODIMENT

Figure 1:
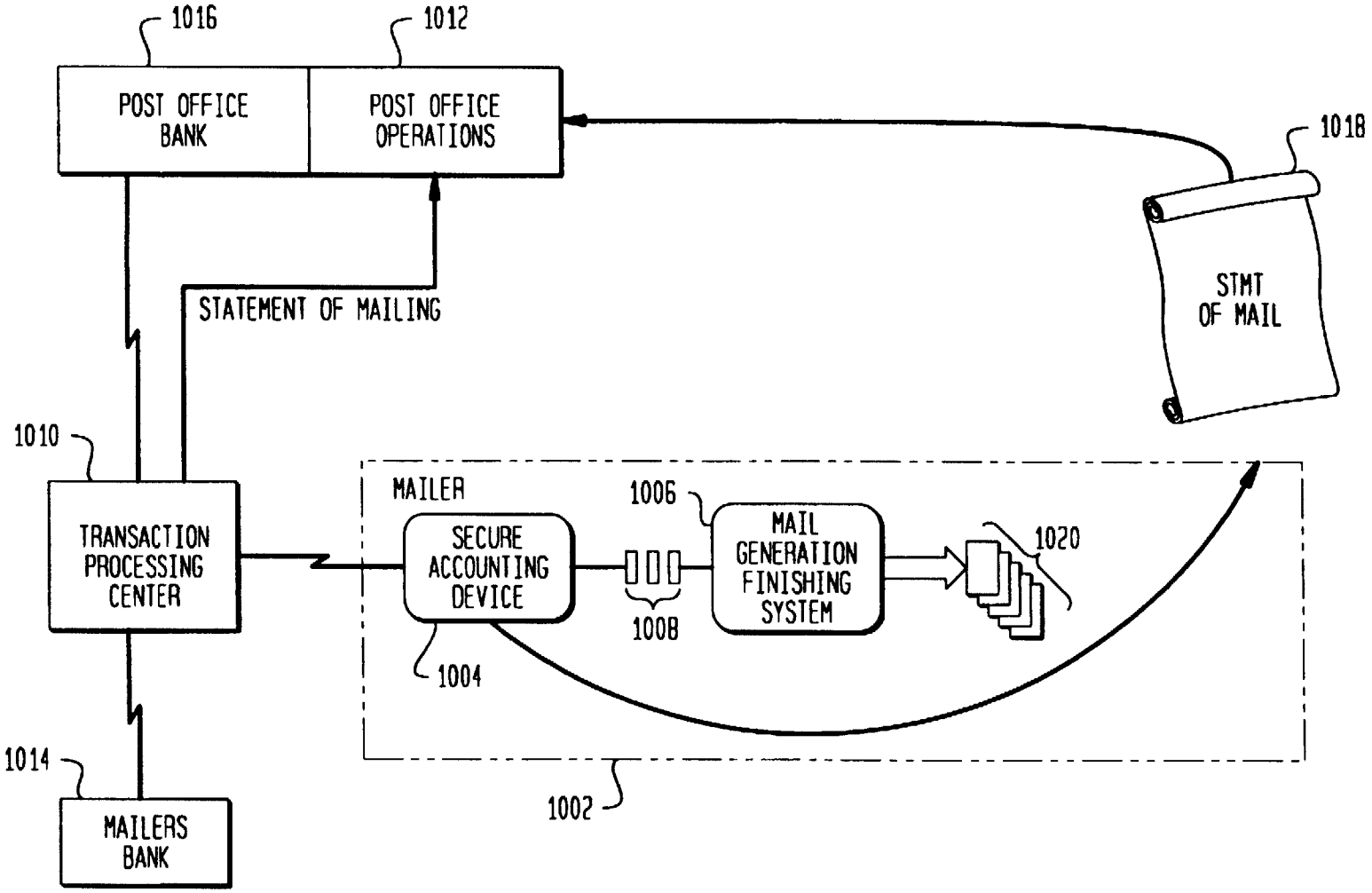
FIG. 1 is a diagrammatic representation of a closed loop transaction based mail accounting and payment system embodying the present invention with the capability of securely reusing digital tokens.

As a general overview, the controlled mail acceptance systems provides the capability for reusing on other mailpieces, digital tokens produced to provide evidence of postage or carrier service payment on a non-mailed (such as a spoiled) mailpieces where other mailpieces are not a recreation of the specific spoiled mailpiece. That is, the non-mailed mailpiece can be replaced with a different mailpiece to a different addressee. This is achieved without sacrificing any security in the system by virtue of the total weight for the batch of mailing being confirmed and a digital token being printed on each mailpiece evidencing proper accounting for (and if desired, also for proper rating) for the specific mailpiece. The digital token allows verification of the accounting and, if desired, verification of the proper rating Because the digital token in the present system is printed without addressee information and may be printed on any mailpiece for which it may qualify because of similar rating, no error documentation file is needed and the system does not employ an error documentation file to account and reconcile for the issuance of plural tokens for use on spoiled mailpieces.

The system issues a digital token only once if the mailpiece is spoiled or otherwise not mailed, the digital token for that mailpiece along with the rating parameters associated with that mailpiece is stored for subsequent use on a completely different mailpiece where the rating parameters are the same. The improper use of digital tokens on more than one mailpiece is detected by the use of a statement of mailing for the total weight of the mail batch where the total weight is reconfirmed at the mail acceptance point as well as by detecting duplicates on a sampling basis.

Additionally, by using the payment system disclosed in pending U.S. patent application Ser. No. 629,719 for CLOSED LOOP TRANSACTION BASED MAILING AND ACCOUNTING AND PAYMENT SYSTEM WITH CARRIER PAYMENT THROUGH A THIRD PARTY INITIATED BY MAILING INFORMATION RELEASE filed Apr. 9, 1996 (E-496), the disclosure of which is hereby incorporated by reference, where non-mailed mail such as a spoiled mailpiece occurs and digital tokens are stored for later use on later mailpieces having similar rating parameters and where such no further mailpieces exist at the completion of the mail preparation operation, these non-used digital tokens may be simply deleted from the secure accounting device and no payment need be made for them as part of the funds transfer. As a result, no reconciliation need be made for these digital tokens and the system provides significantly enhanced functionality.

Security of the system and benefit of the system is achieved by utilizing both the statement of mailing which is a verified signed statement listing all of the mailpieces and including the total weight for the batch of mail and by printing an encrypted indicia on each and every mailpiece. The security benefit from the statement of mailing is that salting of mailpieces into the mail batch is easily detectable and the verified statement of mailing cannot be altered since it is digitally signed. This provides a first level of security with respect to the batch of mailing. The imprinting of the digital token on each mailpiece provides additional separate security in that the detection of duplicate digital indicias in a mail batch or anywhere depending upon the system, provides evidence of fraud which can be investigated. The existence of duplicate digital indicia should not occur in the normally operated system because the generation of the digital tokens is something that will not allow repeating of the same digital indicia as the time changes, the date changes, or the piece count changes, any of which may be included in the digital indicia and renders that particular indicia unique. However, the security of the system is predicated upon the fact that a legitimate indicia exists in single copies within the entire system. Thus, the detection of the indicia in more than one instance provides evidence of improper activity by a mailer.

It should be recognized that although the process will be described in reference to insertion machine, it is fully applicable to other means of mail production and finishing such as mailing machines and mail sorters.

Reference is now made to FIG. 1. A mailer facility 1002 includes a secure accounting device 1004 and a mail generation and finishing system 1006. The mail generation and finishing system 1006 may be any of a large number of mailing systems which creates and processes mailpieces to prepare them for delivery to a carrier. The mail generation and finishing system 1006 is coupled to a secure accounting device 1004 which will be explained in greater detail in connection with FIGS. 2 and 3. The secure accounting device 1004, for each mailpiece to be produced by the mail generation and finishing system 1006, issues a series of digital tokens to be imprinted on the mailpieces. The stream of digital tokens being issued by the secure accounting device 1004 is diagramatically shown as 1008. A digital token is encrypted data that authenticates the value or other information imprinted on the mailpiece. The digital token may include the rating information, the payment value associated with a particular mailpiece and, for example, the serial number or other identifying data relating to the secure accounting device 1004. Samples of systems for generating and using digital tokens are described in U.S. Pat. No. 4,757,537 for SYSTEM FOR DETECTING UNACCOUNTED FOR PRINTING IN A VALUE PRINTING SYSTEM; U.S. Pat. No. 4,831,555 for UNSECURED POSTAGE APPLYING SYSTEM; and, U.S. Pat. No. 4,775,246 for SYSTEM FOR DETECTING UNACCOUNTED FOR PRINTING IN A VALUE PRINTING SYSTEM. Because the digital token incorporates encrypted data including postage value, altering the printed postage value in the postage revenue block is detectable by standard verification procedures. Additionally, the secure accounting device 1004 accounts for each digital token issued to the mail generation and finishing system for imprinting on a mailpiece.

The secure accounting device 1004 further generates and stores the statement of mailing associated with a batch of mail being prepared by the mail generation and finishing system 1006. This statement of mailing is electronically communicated to a remote transaction processing center 1010. This initiates a further transmission of the statement of mailing and authorization for payment to a carrier service 1012. The transmission of the statement of mailing is the release of mailing information by the mailer to a third party, here the transaction processing center, to authorize payment by the processing transaction center to the carrier. The payment may be by the transaction processing center 1010 accessing a mailer account at a financial institution 1014 for either direct payment by the financial institution to the carrier service or by being passed through the transaction processing center and then to the carrier service or carrier service financial institution, as for example, post office bank 1016. To provide a redundancy in the system and for logistics planning, the statement of mailing may additionally be transmitted directly by the mailer 1002 either in electronic and/or in printed form (such as a printed statement of mailing 1018) to the carrier service 1012. The statement of mailing transmission to the carrier service provides a verification, independent of the verification of the transmission occurring via the transaction processing center 1010.

After the statement of mailing has been electronically transmitted by the secure accounting device 1004 to the transaction processing center 1008, the batch of mail 1020 associated with the transaction is physically transmitted to the carrier service 1012. The carrier service then may perform the various control acceptance procedures associated with the carrier service internal processes, as for example, weighing the batch of mail and/or randomly sampling various pieces of mail and verifying them against the statement of mailing.

It should be expressly noted that a number of the digital tokens 1008 issued by the secure accounting device 1004 to the mail generation and finishing system 1006 may be for a mailpiece that becomes non-mailable during processing; however, the digital token, as will be more fully explained hereinafter, may be reused on an alternate completely different mailpiece out of sequence in the mail generation process. This different mailpiece may be to a completely different addressee and may include totally different message or other contents.

The system provides a closed loop transaction in that upon receipt of the statement of mailing by the carrier 1012 and processing of the batch of mail 1020, the carrier communicates either directly or via the transaction processing center 1010 to the mailer 1002 indicating acceptance and processing of the batch of mail 1020.

Various implementations are possible regarding the operation of the secure accounting device 1004. For example, the secure accounting device 1004 will not release the statement of mailing for utilization by the mail processing system until it is initially transmitted electronically to the transaction processing center 1010 and approved by the transaction processing center based on funds availability in the mailer's account 1014. This provides enhanced security assurance of ultimate payment to the carrier, here show as a post office operation.

The process of postage payment is entirely controlled by the mailer 1002. After the mail generation and finishing system has completed preparation of the batch of mail 1020, the mailer, at the time of the mailer's choosing, initiates a communication between the secure accounting device 1004 and the transaction processing center 1010. This communication involves transmission of information related to the statement of mailing to be prepared once authorization is received from the transaction processing center concerning funds availability. At the time the transaction processing center 1010 provides the authorization to the secure accounting device 1004, the transaction processing center 1010 also transfers appropriate funds to the carrier service 1012. Unlike secure accounting devices that store carrier payment value, such as electronic postage meters and other such postage payment devices that store funds, the secure accounting device 1004 does not store prepaid carrier value for use in printing evidence of payment for carrier services. It should be expressly recognized, however, that the present invention involving the use of digital tokens initially intended for a mailpiece that has been spoiled or not generated, for any reason, is equally usable in various other systems where, like electronic postage meters, funds are stored in a secure accounting device.

The communications system shown in FIG. 1 facilitates a bi-directional communications. This communication is particularly useful for providing confirmation to the mailer 1002 as to the provision of certain requested services. Examples of such services are registered or certified mail services for particular mailpieces, insurance payment for particular mail and special delivery for particular mailpieces. All of these and other forms of special services, can be confirmed by the carrier service 1012 through the transaction processing center 1010 to the secure accounting device 1004 to securely store and provide the information to the mailer. Since the communications and storage of information is secure, the receipt of information provides proof of delivery, or deposit and/or other services.

Rating tables and rating information can be communicated from the carrier service 1012 through the transaction processing center 1010 to the secure accounting device 1004. In this manner, the secure accounting device 1004 may be continually updated with the most current and appropriate rating tables for the various mailing activities desired to be implemented by the mailer 1002. It provides an opportunity for the carrier service 1012 to dynamically update the various rating tables and to provide temporary discounts for various services, such as mailing occurring at a particular time, to a particular facility or in a particular manner. This can be utilized to optimize traffic through the carrier system by means of various rating incentives.

Figure 2:
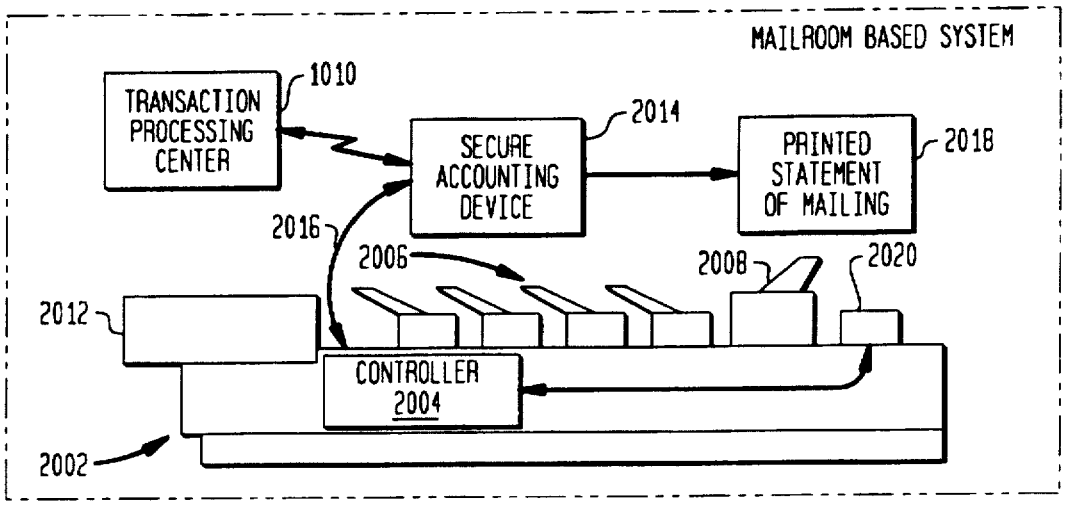
FIG. 2 is a diagrammatic representation of a batch mail generation system suitable for use with the present invention and utilizing an inserter based system adapted to imprint postal indicia.

Reference is now made to FIG. 2. An inserter system 2002 includes a computer controller 2004 for the inserter. The controller 2004 controls both a plurality of feeder modules shown generally at 2006, an envelope insertion module 2008 and a printer 2020. The controller 2004 is further connected to a control document feeder module 2012 and to a secure accounting device 2014 by means of a bi-directional communications channel 2016. The secure accounting device 2014 is operatively connected to a non-secure report printer 2018 utilized to print a statement of mailing and to a printer 2020 for imprinting the indicia, including the digital tokens on each mailpiece of the batch of mail. The printer 2020 is not securely coupled to the inserter controller 2004. Any printer may be utilized at any appropriate point in the process to imprint the encrypted indicia including the digital token on the mailpiece. For example, if the encrypted indicia and digital token are imprinted on the mail contents, they may be employed with a window envelope or they could be imprinted on the envelope prior to insertion of the mailpiece contents.

In operation, under control of the inserter controller 2004, control documents are fed from the control document feeder module 2012 onto the inserter transport (not shown). The control document determines the operation of the various feeder modules 2006 to selectively feed inserts onto the transport to be assembled into a collation and inserted into an envelope fed from the envelope feeder 2008. An assembled mailpiece, not shown, when it reaches printer 2020 has an address imprinted on the envelope such as for non-windowed mail. The assembled mailpieces now may be imprinted with an indicia by the printer 2020. As previously noted, the indicia is an encrypted indicia which includes a digital token provided by the secure accounting device 2014. The printer 2020 may be a general purpose printer suitable for use with an inserter machine and may print other necessary and optional information, such as delivery point postal bar code, advertising material, slogans, and the like. Many other organizations for insertion systems or other mail preparation systems can be utilized with the present invention. For example, rather than employing insertion equipment, mailing machines may be utilized as part of the mail preparation process. Further examples include that the feeder modules 2006 can be directly controlled by the inserter controller 2004 or the insertion process can be controlled via magnetic media such as floppy disks through the controller 2004 as well as different printer arrangements can be employed.

The secure accounting device 2014 communicates with one or more transaction processing centers such as 1010. The communications and further interconnection with the carrier service, not shown in FIG. 2, are described in FIG. 1.

The secure accounting device 2014 also may drive the printer 2018 to print the statement of mailing associated with each batch of mail generated by the inserter system 2002. Alternatively, the printer 2018 may be driven by the controller 2004 which is in communications with the secure accounting device 2014. The secure accounting device 2014 may be associated with a number of other inserting systems or mail preparation systems which may generate a portion of the batch of mail run where job splitting between various equipment is employed.

Figure 3:
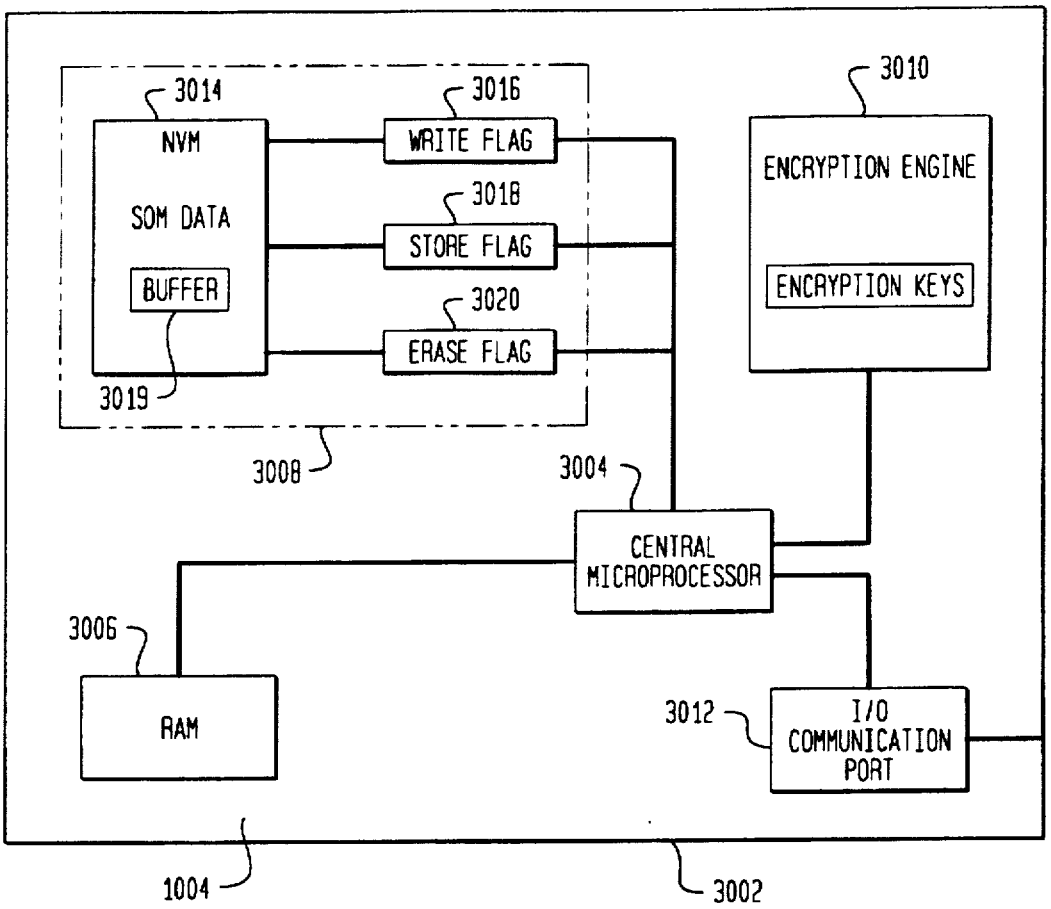
FIG. 3 is a block diagram showing greater detail of the secure accounting device including the encryption engine for executing the digital token transformation to generate digital tokens imprinted on each mailpiece and for cryptographically signing the statement of mailing.

Reference is now made to FIG. 3. The secure accounting device 1004 includes a tamper resistant housing 3002. Within the tamper resistant housing is a central microprocessor 3004 for controlling the operation of the secure accounting device 1004. The microprocessor and various related microprocessor and/or microcontroller devices and systems are suitable for utilization as part of the secure accounting device 1004. A random access memory 3006 wherein mailpiece data may be stored is connected to the central microprocessor 3004. Additionally connected to central microprocessor 3004 are non-volatile memories subsystems 3008 and an encryption engine subsystem 3010. Communications to the secure accounting device are by way of an input/output communications port 3012. The non-volatile memory subsystem 3008 includes a non-volatile memory 3014 which is controlled by the microprocessor via three operational flags. These flags may be implemented in either separate hardware structure or in areas within the non-volatile memory device 3014. A write flag 3016, is utilized to enable writing into the non-volatile memory 3014 via the central microprocessor 3004. A store flag 3018 is actuated after a writing operation has been completed. The actuation of the store flag precludes later modification of data in the non-volatile memory 3014. Accordingly, data may be written into the non-volatile memory 3014 via the write flag 3016 and may be changed and modified. However, once the store flag 3018 is set, modification of this data is precluded. Notwithstanding the fact that the data may not be modified once the store flag 3018 is set, the data, in its entirety, may be erased by actuation of an erase flag 3020. Thus, data may be written into the memory and modified; however, once the store flag is set it may not be modified but only erased in its entirety via actuation of the erase flag 3020. This provides enhanced security since the data can be erased and changed while in progress, but once completed it may not be modified. The non-volatile memory 3014 also includes a buffer area 3019 which allows the temporary buffering of information within the non-volatile memory and is employed in a manner which is described in connection with FIG. 14.

The encryption engine module 3010 is employed to encrypt communications and decrypt communications that are transmitted from or are received by the secure accounting device 1004 via the I/O communications port 3012. The encryption engine 3010 is also utilized to generate the digital signature for the statement of mailing. That is, the statement of mailing is run through a hash code function and the resulting output is then encrypted using protected encryption keys.

Figures 4, 5:
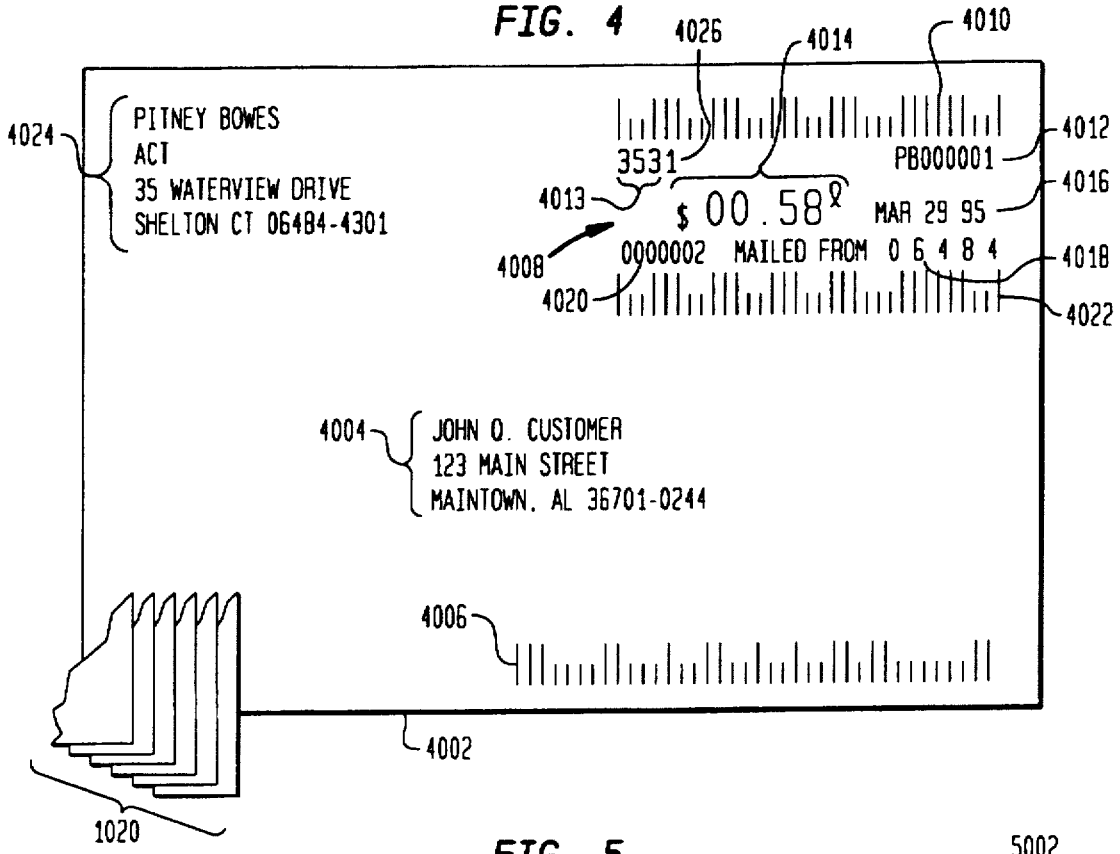
FIG. 4 is a depiction of mailpieces created in accordance with the present invention based on the system shown in FIG. 1 and employing a digital token originally generated for use on a non-mailed or spoiled mailpiece.
FIG. 5 is a statement of mailing suitable for use in the present system without being linked to a digital token error recovery file.

Reference is now made to FIG. 4. The batch of mail 1020 includes a mailpiece 4002. The mailpiece contains addressee information shown generally at 4004, a postal delivery bar code 4006 and an encrypted indicia shown generally at 4008. The encrypted indicia including the digital tokens can be formatted in many ways depending upon the requirements of the particular carrier service involved. Additionally, different information may be included or omitted from the encrypted indicia depending upon the needs and requirements of the carrier service. The encrypted indicia 4008 includes a secure accounting device identification number represented as bar code 4010 shown in alphanumeric representation as PB0000001 at 4012. The indicia 4008 further includes an imprinted number "353" shown at 4013. The first digit "3" is an error correcting digit and the next two digits "5" and "3" are carrier service and vendor digital tokens, respectively. It should be specifically noted that the digital tokens are digital tokens initially generated in connection with mailpiece 4002 which was, for example, spoiled during preparation and has been used in collation number 7 as will be explained hereinafter.

One suitable system for verification using two encrypted tokens is disclosed in U.S. Pat. No. 5,390,251 for MAIL PROCESSING SYSTEM INCLUDING A CARRIER DATA CENTER VERIFICATION FOR MAILPIECES. These digital tokens enable the carrier service or the vendor to separately authenticate the validity of the encrypted indicia 4008. Moreover, the digital tokens can be pre-computed. Reference is made to pending U.S. patent application Ser. No. 08/242,564 filed May 13, 1994 for ADVANCED POSTAGE PAYMENT SYSTEM EMPLOYING PRE-COMPUTED DIGITAL TOKENS WITH ENHANCED SECURITY, assigned to Pitney Bowes Inc. The disclosure of which is hereby incorporated by reference.

The encrypted indicia further includes the imprint of the postage amount of 58¢ for the mailpiece at 4014, the date at 4016, the originating postal code at 4018, the sequential piece count for the secure accounting device "0000002" at 4020. It should be noted that this sequential piece number is 2 even though the mail collation is number 7. Thus, the sequential number 2 is encrypted into the mailpiece collation 7 as part of the vendor and carrier service digital tokens. Bar code at 4022 is a machine readable representation of piece count 4020. A return address which may also include the originating postal code is shown at 4024.

Additionally, included on the mailpiece is a statement of mailing serial number 4026. This statement of mailing serial number, here shown for example, as a single digit "1", uniquely identifies the statement of mailing which accounts for a given mailpiece on a given day. This provides a unique verifiable linkage between the physical mailpiece in a batch of mail and the associated statement of mailing for the batch. This verification, as will be apparent when the statement of mailing is explained, is bidirectional. This means that when the mailpiece is inspected it can be uniquely linked to a statement of mailing which has been transmitted to the carrier service 1012. Correspondingly when a statement of mailing is inspected, it can be uniquely associated with a particular mailpiece such as 4002.

It should be recognized that the information described above was in connection with mailpiece information desirably utilized to accomplish the authentication and verification of payment for mail submitted to the carrier service. However, additional information may be beneficially included on the mailpiece such as the date of last inspection of the secure accounting device, a request for special services for a given mailpiece, such as express mail, a track and trace function and any delivery instructions. This may be imprinted on the mailpiece as a separate imprint or as a machine readable bar code which may be encrypted and may be digitally signed.

It should also be recognized that the physical formatting of the information printed on the mailpiece is a matter of choice and may be either imprinted in the address block, the revenue block, both areas, or in some other organization on the mailpiece.

Reference is now made to FIG. 5. A printed statement of mailing is shown at 5002. The statement of mailing is submitted to the carrier service prior to the physical submission of the batch of mail 1020. The timing of the submission of the statement of mailing and the physical mail is important and plays a critical role in the acceptance procedure. The statement of mailing 5002 is provided, as previously explained, by the transaction processing center 1010 and to the carrier service 1012. Additionally, as previously noted, the statement of mailing 5002 can also be provided by the mailer to the carrier service 1012 either as a printed document and/or electronically on a storage medium.

The statement of mailing, includes the statement of mailing serial number 5004, mailer identification at 5006, a secure accounting device identification at 5008 and a mailer account at 5010. Each mailer may have several different accounts which are accessed by the transaction processing center 1010 for use in different applications and each account may have several different secure accounting devices such as 1004 associated with it. The piece count range is also provided at 5012. The range which runs from 0001 through 1411 is a broken range and does not correspond to the total number of mailpieces. That is, piece count 3 has not been used in the system for the batch of mail. Piece count 2 was used; however, it was used in collation number 7. Thus, for the particular batch of mail there was one non-mailable, for example spoiled, mailpiece where the piece count was not reused and the digital token associated with the particular piece count was not reused thus, the total number of mailpieces in the batch is one less ("1410 shown at 5028) than the highest piece count number 1411. Of course, if the piece count range does not start at 1 other adjustments would be reflected between the piece count number, piece count gaps and the total number of mailpieces. This is all verifiable by the carrier service. Thus, if a mailpiece including piece count 3 were to appear in the batch of mail, the postal service would institute further investigation to determine the reason for such discrepancy since it would be an indication of improper activity. Also provided as part of the statement of mailing is the date of submission at 5014 and the identification of the rating table employed at 5016. The rating table identification may be a truncated encrypted hash code of the rating table employed in a manner described in the above noted patent, U.S. Pat. No. 5,448,641 for POSTAL RATING SYSTEM WITH VERIFIABLE INTEGRITY. The address and postal code of the accepting post office is provided at 5017.

A digital signature of the entire statement of mailing, is provided at 5018 and an error control code at 5020 to facilitate error detection and correction when machine reading the statement of mailing. This control code is particularly useful if the statement of mailing is printed and physically presented to the postal service or carrier service 1012.

The statement of mailing further contains information for groups of mailpieces which are similar in weight, size, discount and carrier payment or postage. For example, on line 1 at 5022, 731 pieces with postage of 32¢, the full postage rate of the standard size US mailpiece and with the actual weight of 5/10 of an ounce are listed. Similarly, in the following entries various groups of mailpieces having similar weight, size, discount and postage are listed. The various totals, such as the total weight of the mailpieces in the batch are provided at 5024 along with the total postage at 5026 and the total number of mailpieces at 5028.

The organization and content of the statement of mailing 3002 is a matter of preference depending on the needs of the mailer, carrier and transaction processing center.

Reference is now made to FIG. 6. A list of collations in process (LCP) 6002 includes a list of the first six collations (mailpieces) which were accounted for in the secure statement of mailing stored in the secure accounting device 1004. Collations 5 and 6 are not shown. The last three collations, 6006 are at a stage when the indicia information request to the secure accounting device 1004 are still in the queue. When some of the collations, for example, collation number 2 and collation number 3 designated by 6008 and 6010, respectively, cannot be finished due to some malfunction, the inserter controller places these collations indicia information on a second list of indicias available for reuse (IAR) shown in FIG. 7. As will be noted in connection with FIG. 6, various information is included regarding each of the collations including the collation number at 6012, rating information at 6014 and indicia variable information at 6016. Referring to one specific collation in its entirety, collation 2 designated by 6008 includes the collation number 2, the weight of 1.7 ounces the size of a standard and service first class. The piece count is designated as 0000002, the scan error correction code as 367 with a postal token "5", a vendor token "3" and a postage amount of 58¢. Similar types of information is provided for each collation.

Reference is now made to FIG. 7. This list of indicias available for reuse (IAR) includes the indicias associated with collations 2 and 3, (6008 and 6010 respectively). This includes the information previously noted in connection with FIG. 6, however, a sequential number of indicias available for reuse is also included at 7004.

Reference is now made to FIG. 8 which is a list of completed indicias (LCI). A sequential number of completed indicia is included at 8002. This is a list of fully assembled and finished mailpieces with printed and accounted for indicias. Soon as the inserter controller recognizes or is notified regarding the problems with collations 2 and 3, specifically collations designated at 6008 and 6010, the inserter controller 2004, or other suitable processing system for other type of mail preparation equipment, searches the list of collations in process, which have a request for indicias in the queue in order to find possibilities for reusing indicia information already received for collation 2 and collation 3. In this search, the deciding compatibility factor is the identity of rating parameters, and, typically and often most importantly, the weight. For example, collation number 7 shown in FIG. 6 has the same rating parameters as non-mailable, for example spoiled, collation number 2 6008 (with sequential IAR #"1" as shown in FIG. 7). Therefore the indicia information for collation number 2 can be reused for collation number 7.

The inserter controller 2004 shown in FIG. 2 then removes the indicia number 1 from the list of indicias available for reuse and places it into the first list in position number 7 as shown in FIG. 9. This is an operation of the indicia transplantation or reuse where the indicia or digit token originally intended for non-mailable or not prepared collation 2 is taken from the list of indicias available for reuse and utilized with collation number 7. The list of collations in process after reuse of indicia number 2 is shown in FIG. 9. Collation number 7 includes the digital token associated with original collation 2 and the piece count associated with collation 2. Thus, the piece count sequence for the various collations is no longer in order in the physical mail stream.

As will be apparent from FIG. 10, the list of indicias available for reuse after reuse of indicia 2 includes only one indicia token shown for piece count 0000003. When the inserter controller 2004 receives a signal that a mailpiece has been fully assembled and finished including printing of the indicia, then the list of collations in process and the list of completed indicias are updated by removing the indicia information from the former list and placing it on the latter one. For example, after collation number 7 has been successfully finished, list of collations in process and completed indicias are as shown in FIGS. 11 and 12, respectively. It can be seen in FIG. 11, that collation 8, at 1104 and collation 9, at 1106 are presently in the process of completion, collation 7 having been completed. As can be seen in FIG. 12, completed indicia 1 for collation number 1 utilizes piece count 1 as shown at 1204. Completed indicia 2 associated with collation 4 utilizes piece count 4 as shown at 1206. Completed indicia 5 associated with collation 7 employs piece count 2 as shown at 1208. This shows the sequence of indicias that were completed on the mailpieces as the process continues. Since mailpieces 2 and 3, that is collations 2 and 3, where spoiled in process (or not generated) and only the digital token from collation 2 was reutilized, piece count 3 is missing from the sequence of completed indicias and remains as a indicia available for reuse shown in FIG. 10. If desired as part of the information retained in FIG. 12, an associated collation can be included with the completed indicia number. This would assist the mailer if the destroyed pieces are retained and any information is available from them to verify the processes proceeding appropriately.

Figure 13:
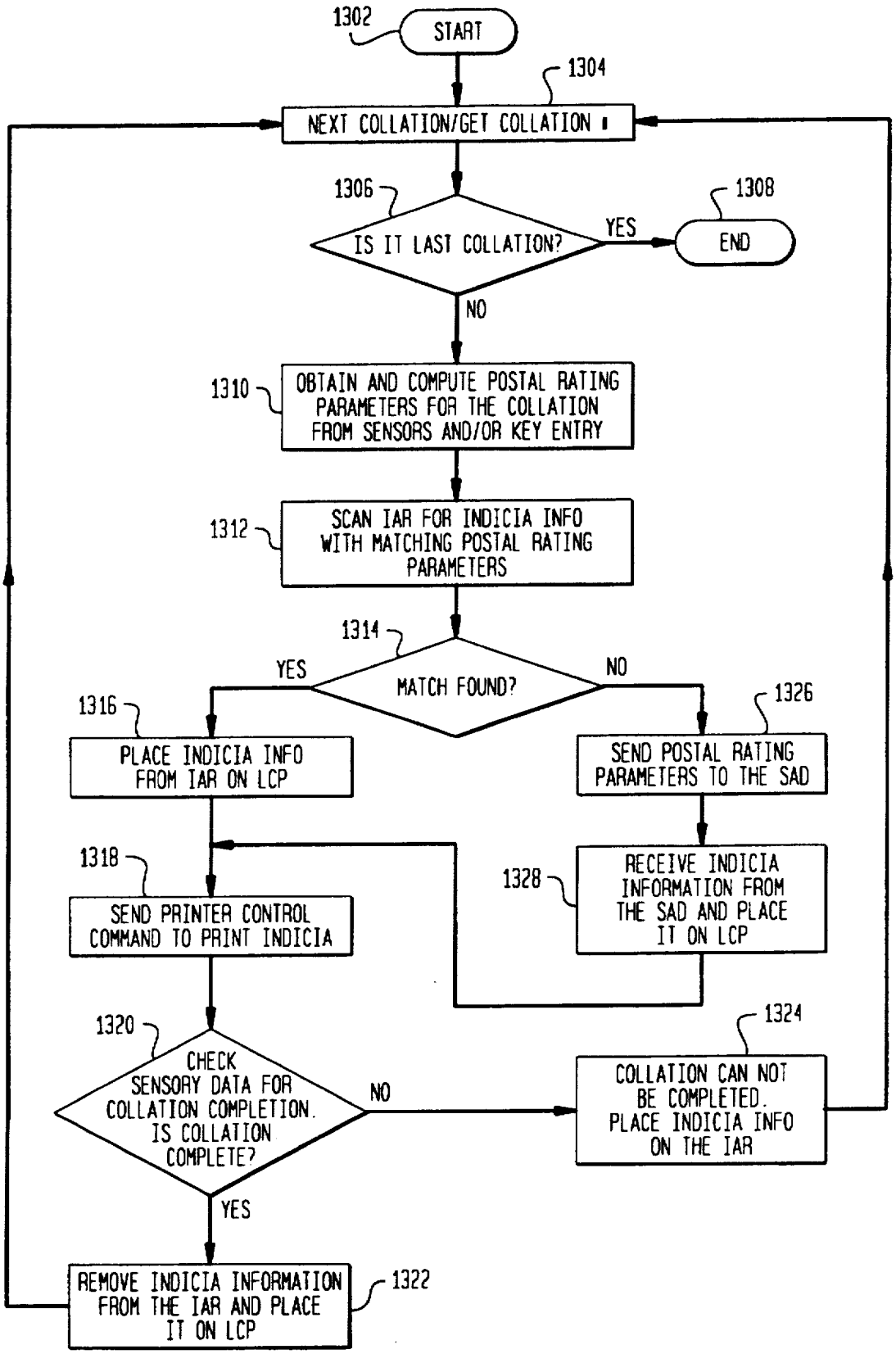
FIG. 13 is a flow chart of the inserter controller process helpful in an understanding of the present invention.

Reference is now made to FIG. 13. The inserter controller process commences at 1302. The next collation is obtained at 1304 and a determination is then made at 1306 if this is the last collation. If it is the last collation, the process ends at 1308. If it is not the last collation, postal rating parameters for the collation from sensors and other and/or key entry information is obtained and postal rating is computed at 1310. The indicias available for use matching postal rating parameters is then scanned at 1312. If a match is found at 1314 of indicias available for reuse, indicia information from the list of indicias available for reuse is moved to the list of collations in process at 1316. A command is sent to the printer to cause the printer to print the indicia at 1318. A determination is then made at 1320 if the collation is completed and properly printed. If this is the case, at 1322 the indicia information is removed from the list of collations in process and placed on the list of completed indicias. The system then loops back to get the next collation number. If on the other hand the collation completion does not occur at 1320, the indicia is then again placed on the list of indicias available for reuse at 1324 and the system loops back to get the next collation at 1304.

If after step 1312, no match is found at 1314 for an indicia available for reuse, the postal rating parameters are sent to the secure accounting device at 1326. Indicia information is received from the secure accounting device and is placed on the list of collations in process at 1328. The system then loops back to proceed with sending a print command to the printer controller to print the indicia at 1318.

Figure 14:
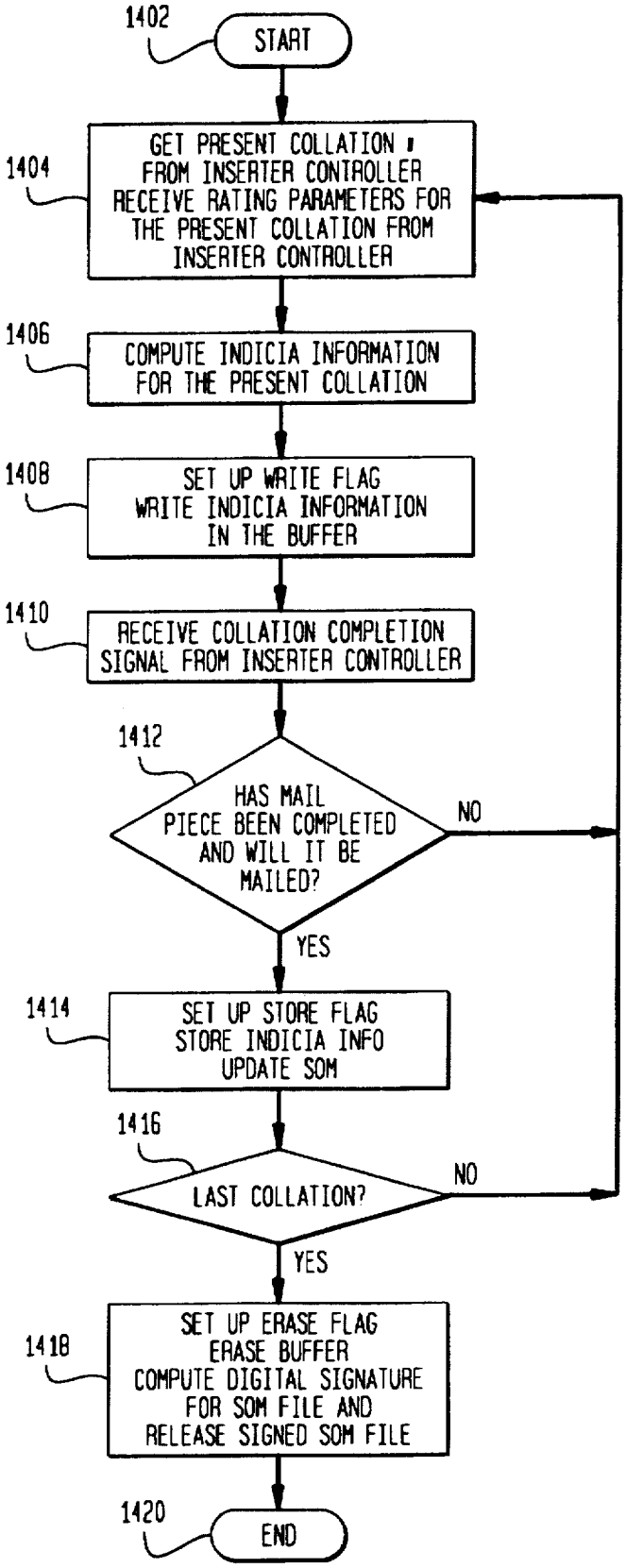
FIG. 14 is a flow chart of the statement of mail generation process performed in the secure accounting device and helpful to an understanding of the present invention.

Reference is now made to FIG. 14. The process starts at 1402. The present collation number is obtained from the inserter controller and the rating parameters are received for the present collation from the inserter controller at 1404. The indicia information for the present collation is then computed at 1406. A write flag is set up and indicia information is written into the buffer at 1408. A collation completion signal from the inserter controller is received at 1410. At this time a determination is made if the mailpiece is completed and if it will be mailed at 1412. If this is the case, the Store Flag is set at 1414 and the indicia information is stored and updated in the statement of mailing. If, on the other hand, the mailpiece has not been completed and will not be mailed the system loops back to step 1404. A determination is made at 1416 whether this is the last collation. If it is not, the system loops back to step 1404.

If it is the last collation, the Erased Flag is set up and the information stored concerning indicias in process is erased from the buffer.

It should be expressly noted that the indicias erased from the buffer may be used by unscrupulous mailers to create a unpaid mailpieces with faked indicias. In this case such a mailer might obtain sequential piece counts of unused indicias stored in the buffer and would imprint mailpieces with piece counts and corresponded real or counterfeited digital tokens. Then after a discrepancy between actual and reported weight of a batch is discovered during the acceptance procedure, finding evidence of fraud would be more difficult compared to a manual inspection of piece counts in the batch and may require a scanning of a sample of mailpieces.

In order to avoid this complication, the system can be configured to store an ordered list of unused piece counts, digital tokens or other useful information in the statement of mailing before erasing the buffer. In this case, a manual inspection of a sample of mailpieces can be done against the statement of mailing just based on printed piece counts, digital tokens or other useful information. Thus, an inspector, for example, may simply check every mailpiece in the batch in order to determine whether a piece count in the indicia is outside of the range reported in the statement of mailing and whether it is a duplicate piece count already encountered in the sample. This avoids a considerable cost of scanning mailpiece in order to obtain evidence of fraud. If this system is implemented the operation shown in FIG. 14 would contain an additional process block before the block 1418 storing an ordered list of unused piece counts in the NVM and in the statement of mailing before computing the digital signature and releasing the statement of mailing file.

The digital signatures for the statement of mailing file is computed and the signed statement of mailing is released to the inserter controller and transmitted to the transaction processing center and to the Post Office operations as shown and described in FIG. 1. Thereafter the process ends at 1420.

While the present invention has been disclosed and described with reference to the disclosed embodiments thereof, it will be apparent, as noted above, that variations and modifications may be made. For example, the mailer's computer, which contains mailing address lists, can perform address cleansing and send the address list to the inserter in a mail run data file. This file would contain control information for matching the control documents with the corresponding envelopes. This can be done employing, as previously noted, digital tokens which utilize addressee information or do not utilize addressee information. It is, thus, intended in the following claims to cover each variation and modification that falls within the true spirit and scope of the present invention.

What is claimed is:

1. A method for mail payment evidencing comprising:

processing a collation of mail where said collation is one of a series of mail collations being created;

determining if a previously generated digital token associated with a previous mail collation which was not completed is suitable for use on said mail collation in process; and, utilizing said previously generated digital token for said mail collation in process if said previously generated digital token is suitable for use on said mail collation in process.

2. A method for mail payment evidencing as defined in claim 1 wherein said determining if a previously generated digital token associated with a previously collation which was not completed is suitable for use on said mail collation is based on all of the rating parameters for carrier service for said previous mail collation which was not completed and said mail collation in process being the same.

3. A method for mail payment evidencing as defined in claim 1 including maintaining a list of previously generated digital token associated with a previous mail collations which were not completed.

4. A method for mail payment evidencing as defined in claim 3 wherein said digital tokens are generated without addressee information.

5. A method for mail payment evidencing as defined in claim 1 including generating a statement of mailing for the created mail collations to be submitted to the carrier service, said statement of mailing including data concerning generated digital tokens not utilized in said series of completed mail collations.

6. A method for mail payment evidencing as defined in claim 5 wherein said statement of mailing data concerning generated digital tokens not utilized in said series of completed mail collations is piece count data.

7. A method for mail payment evidencing as defined in claim 6 including digitally signing said statement of mailing.

8. A method for mail payment evidencing as defined in claim 1 further comprising generating a statement of mailing without an error documentation file to account and reconcile for the issuance of said previously generated digital token utilized in said series of completed mail collations.

9. A method for mail payment evidencing as defined in claim 8 further including digitally signing said statement of mailing prior to submission of said completed collations to said carrier service.

10. A method for mail payment evidencing as defined in claim 1 including determining payment rating parameters for carrier services to be associated with said mail collation in process and wherein said determining if a previously generated digital token associated with a previously collation which was not completed is suitable for use on said mail collation is based on the similarity of at least one rating parameter of the carrier service between said previous mail collation which was not completed and said mail collation in process.

11. A method for mail payment evidencing as defined in claim 10 wherein said determining if a previously generated digital token associated with a previously collation which was not completed is suitable for use on said mail collation is based on said at least one rating parameter of the carrier service between said previous mail collation which was not completed and said mail collation in process being the same.

12. A method for mail payment evidencing as defined in claim 11 wherein said one rating parameter is the anticipated weight of said previous mail collation which was not completed and of said mail collation in process.

13. A method for mail payment evidencing as defined in claim 10 wherein said determining if a previously generated digital token associated with a previously collation which was not completed is suitable for use on said mail collation is based on the similarity of more than one rating parameter carrier service between said previous mail collation which was not completed and said mail collation in process.

14. A method for mail payment evidencing as defined in claim 13 wherein said rating parameters include anticipated special handling carrier services for said previous mail collation which was not completed and said mail collation in process.

15. A system for mail payment evidencing system, comprising:

means for processing a collation of mail where said collation is one of a series of mail collations being created;

means for determining if a previously generated digital token associated with a previous mail collation which was not completed is suitable for use on said mail collation in process; and, means for utilizing said previously generated digital token for said mail collation in process if said previously generated digital token is suitable for use on said mail collation in process.

16. A system for mail payment evidencing as defined in claim 15 wherein said determining if a previously generated digital token associated with a previously collation which was not completed is suitable for use on said mail collation is based on all of the rating parameters for carrier service for said previous mail collation which was not completed and said mail collation in process being the same.

17. A system for mail payment evidencing as defined in claim 15 including means for determining payment rating parameters for carrier services to be associated with said mail collation in process and wherein said determining if a previously generated digital token associated with a previous collation which was not completed is suitable for use on said mail collation is based on the similarity of at least one rating parameter of the carrier service between said previous mail collation which was not completed and said mail collation in process.

18. A system for mail payment evidencing as defined in claim 17 wherein said determining if a previously generated digital token associated with a previously collation which was not completed is suitable for use on said mail collation is based on said at least one rating parameter of the carrier service between said previous mail collation which was not completed and said mail collation in process being the same.

19. A method for mail payment evidencing as defined in claim 18 wherein said one rating parameter is the anticipated weight of said previous mail collation which was not completed and of said mail collation in process.

20. A system for mail payment evidencing as defined in claim 18 wherein said determining if a previously generated digital token associated with a previously collation which was not completed is suitable for use on said mail collation is based on the similarity of more than one rating parameter carrier service between said previous mail collation which was not completed and said mail collation in process.

* * * * *